United States Patent [19]

Chibana

[11] 4,132,140

[45] Jan. 2, 1979

[54] ELECTRONIC MUSICAL INSTRUMENT BY DIGITALLY CALCULATING HARMONICS AND COEFFICIENTS

[75] Inventor: Masanobu Chibana, Hamamatsu, Japan

[73] Assignee: Nippon Gakki Seizo Kabushiki Kaisha, Hamamatsu, Japan

[21] Appl. No.: 843,506

[22] Filed: Oct. 18, 1977

[51] Int. Cl.[2] ..... G10H 5/02

[52] U.S. Cl. ..... 84/1.11; 84/1.22; 84/1.19

[58] Field of Search ..... 84/1.01, 1.03, 1.11, 84/1.12, 1.19, 1.20, 1.21, 1.22, 1.26, 1.27

[56] References Cited

U.S. PATENT DOCUMENTS

| | | | |
|---|---|---|---|
| 3,809,786 | 5/1974 | Deutsch | 84/1.01 |
| 3,823,390 | 7/1974 | Tomisawa | 84/1.01 |
| 3,913,442 | 10/1975 | Deutsch | 84/1.11 |
| 3,992,971 | 11/1976 | Chibana | 84/1.11 |
| 4,036,096 | 7/1977 | Tomisawa | 84/1.01 |
| 4,083,285 | 4/1978 | Chibana | 84/1.26 |

*Primary Examiner*—Robert K. Schaefer

*Assistant Examiner*—William L. Feeney

*Attorney, Agent, or Firm*—Cushman, Darby & Cushman

[57] ABSTRACT

In an electronic musical instrument, the amplitudes of respective partial components constituting a composite waveshape at successive sample points are produced, these amplitudes are multiplied, at regular time intervals individually by coefficients each being associated with corresponding partial components to obtain the amplitudes weighted, these weighted amplitudes being accumulated successively to obtain the net amplitudes weighted of the composite waveshape for each sample point. The net amplitudes are converted to a musical sound by sounding means. The coefficients are repetitively calculated at another regular time intervals, each of which being longer than the foregoing regular time interval, by implementing the algorithm of a certain function of time, as the multiplications are carried out.

This instrument is capable of producing a musical sound whose tonal quality will change with the lapse of time in accordance with a certain function of time, without employing an expensive high-speed calculating device which will increase the cost of the instrument.

10 Claims, 10 Drawing Figures

ELECTRONIC MUSICAL INSTRMENT BY DIGITALLY CALCULATING HARMONICS AND COEFFICIENTS

BACKGROUND OF THE INVENTION (a) Field of the Invention

The present invention is related to an electronic musical instrument wherein a musical sound is produced by computing the amplitudes of respective partial components of an aimed musical sound waveshape at successive sample points of the musical waveshape and by converting these computed amplitudes to a musical sound, as the computations of the amplitudes are carried out.

(b) Description of the Prior Art

U.S. Pat. No. 3,809,786 entitled COMPUTER ORGAN discloses an electronic musical instrument wherein the amplitudes at successive sample points of a musical sound waveshape aimed are computed and then converted to a musical sound as the amplitude computations are carried out. In this instrument, a discrete Fourier algorithm is implemented to calculate the individual harmonic component amplitudes at each sample point, using a stored set of harmonic coefficients which characterize the resultant waveshape. For each sample point, the amplitudes of plural harmonic components are calculated individually by multiplying the coefficient associated with each harmonic component by a sine value related to the sample which value is read out from a sinusoid table memory. The instrument includes means for programmatically scaling the harmonic coefficients as a whole with lapse of time to obtain such sound amplitude transient effects as the attack and decay effects, and so forth. However, it contains no means for changing the individual harmonic coefficients, independently of each other, with time lapse to obtain a tonal quality variation characteristic of the resultant musical sound with respect to time. Therefore, this prior art instrument is not able to produce a musical sound much realistically simulated to that of the most natural musical instruments of which tonal quality will change slightly with the lapse of time.

Another prior art electronic musical instrument of the type described, which is capable of producing a musical sound whose tonal quality varies with time lapse, is disclosed by Japanese patent application No. 49-111818 (Laid-open on Apr. 15, 1976 under the laying-open No. 51-43912). This instrument is so designed that the individual harmonic coefficients are varied individually with lapse of time, causing the relative amplitudes of the respective harmonic components, i.e., the tonal quality of the resultant musical sound to change with time. The harmonic coefficients are calculated at a high speed by a calculating device as the amplitude calculations are carried out, as described below referring to FIG. 1. The amplitudes for each sample point of an aimed musical waveshape are calculated at regular time intervals $T_1$, and hence, if 16 harmonic components, for instance, are evaluated in the calculation of the amplitude, the calculation for each harmonic component must be accomplished in a time interval $T_2 = T_1/16$, which is usually a relatively short period of time. This prior art instrument is arranged so as to accomplish the calculation of each harmonic coefficient at such a short time interval $T_2$, which leads to the accompaniment by a difficulty in implementing the harmonic coefficient calculation. In other words, an expensive high-speed calculating device is required for calculating the harmonic coefficients, resulting in a higher cost of the instrument as a whole.

SUMMARY OF THE INVENTION

Therefore, the present invention is intended to solve the drawbacks of the prior art, and an object of the present invention is to provide a novel configuration of an electronic musical instrument capable of producing a musical sound much realistically simulated to a natural musical instrument sound with a tonal quality time variation characteristic.

Another object of the present invention is to provide an electronic musical instrument of the type described, which does not include such an expensive high-speed calculating device as will undesirably augmenting the cost of the instrument.

According to an aspect of the present invention, the amplitudes of the individual harmonic components for each sample point of a musical waveshape are calculated at a high speed, using a set of harmonic coefficients read out from a buffer memory, and summed algebraically in an accumulator to obtain the net amplitudes of the aimed musical sound waveshape at a sample point. The individual harmonic coefficients are calculated by a calculating device at a relatively low speed as compared with the calculation speed of the amplitudes at the individual harmonic component, as the calculations of the amplitudes at the sample point of the musical sound waveshape are conducted, and a calculated set of harmonic coefficients is transferred to the buffer memory to be stored therein. The stored set of harmonic coefficients are then read out successively from the buffer memory and are used in the calculations of the amplitudes at plural consecutive sample points. As such, in this instrument, the same set of harmonic coefficients is used repetitively for calculating the amplitudes at a plural number of successive sample points. This, however, is not a serious problem since the tonal quality of the sounds of a natural instrument will change with time at a relatively low speed.

These and other objects as well as the features and the advantages of the present invention will become apparent in the following detailed description of the preferred embodiments when taken in conjunction with the accompanying drawings.

BRIEF DESCRIPTION OF THE DRAWINGS

A detailed description of the present invention will be made with reference to the accompanying drawings wherein like reference numerals designate like components in several figures thereof.

DETAILED DESCRIPTION OF THE PREFERRED EMBODIMENTS

Figures 1, 2:
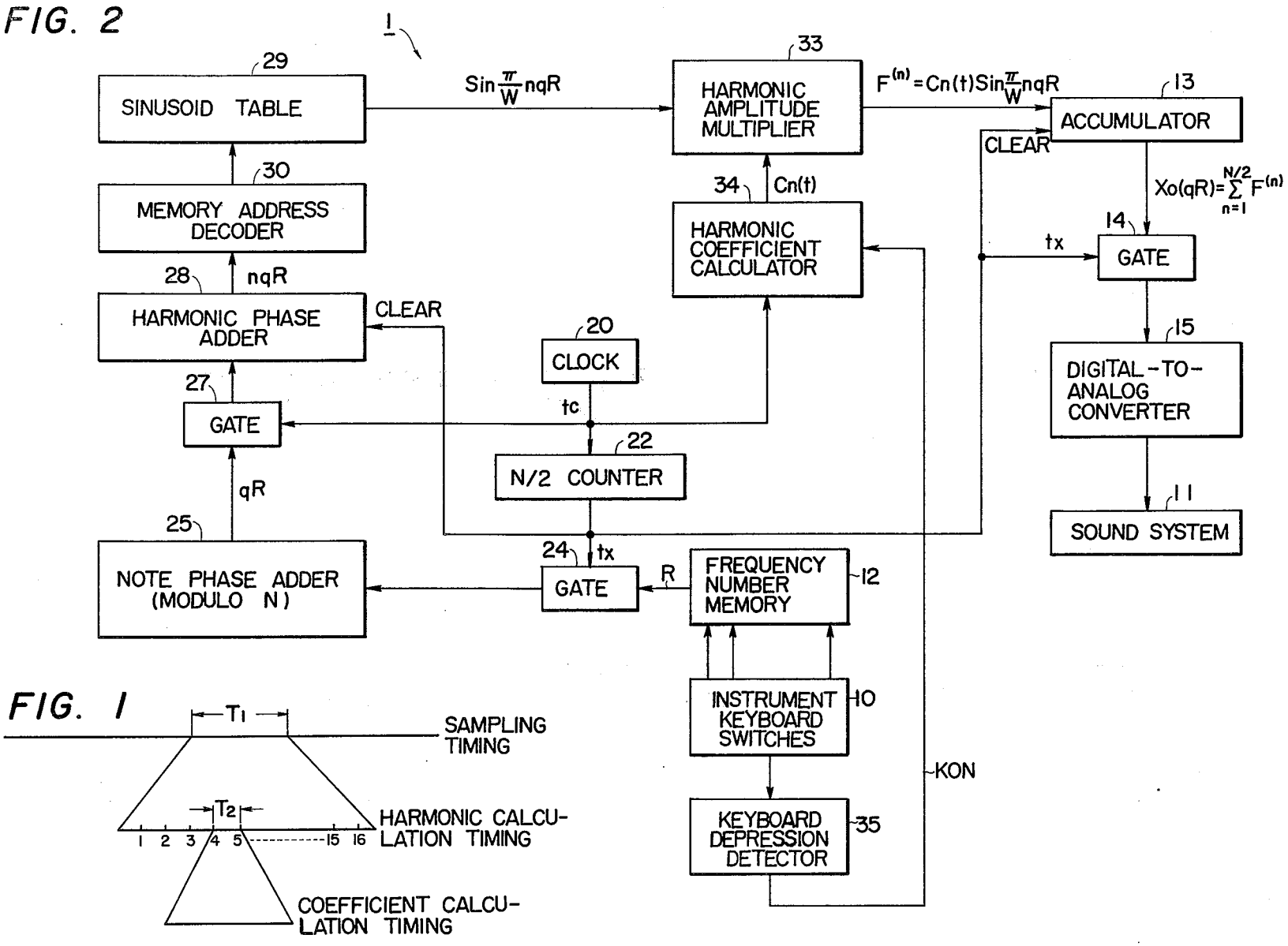
FIG. 1 is a timing diagram illustrating the computation timings of the sample point amplitude and of the individual harmonic coefficients in the prior art electronic musical instrument.
FIG. 2 is a block diagram of an electronic musical instrument embodying the present invention.

Referring to FIG. 2, an example of the electronic musical instrument according to the present invention will be explained in detail. The musical instrument operates to produce, via a sound system 11, a musical note selected by closing one of instrument keyboard switches 10. The amplitudes at successive sample points of an aimed musical sound waveshape are calculated digitally at regular time intervals $t_x$ and are converted to analog values as the input of the sound system 11, as the amplitude calculations are carried out. The fundamental frequency of generated musical sound is established by a frequency number R selected by the keyboard switches 10. A set of such frequency numbers R corresponding to the notes of the instrument is stored in a frequency number memory 12.

The waveshape amplitude X(qR) at each sample point is computed in accordance with the following discrete Fourier representation of a sample periodic complex waveshape:

$$X(qR) = \sum_{n=1}^{N/2} C_n(t) \cdot \sin\frac{\pi}{W} nqR \qquad \text{(Eq. 1)}$$

wherein q represents an integer incremented for each time interval $t_x$; R represents the frequency number mentioned above; the value of qR designates a sample point of the waveshape; $n=1, 2, 3, \ldots$; $W = N/2$ designates the harmonic component being evaluated; and $C_n(t)$ represents the n-th harmonic component coefficient which specifies the relative amplitude of the respective n-th harmonic component and, in the present invention, is a function of time. The individual harmonic component amplitudes $F^{(n)} = C_n(t) \cdot \sin(\pi/W)$ $nqR$ for each sample point are separately calculated at regular time intervals $t_c = t_n/W$ and then transferred to an accumulator 13 to be accumulated. Thus, at the end of each time interval $t_x$, the net amplitude X(qR) at the sample point of the musical sound waveshape is obtained in the accumulator 13, the obtained waveshape amplitude being converted through a digital-to-analog converter 15 to an analog voltage or current as an input to the sound system 11.

The timing pulse $t_c$ is generated from a clock oscillator 20 to specify the calculation intervals $t_c$. A counter 22 of modulo N/2 provides an output for each N/2 pulse $t_c$ received from the clock oscillator 20, this output comprising a computation interval timing pulse $t_x$ for specifying the calculation intervals $t_x$.

At the beginning of a computation cycle, the frequency number R selected by a depressed keyboard switch 10 and supplied via a gate 24 is added to the preceding content of a note phase adder 25 of preferably N modulo. The gate 24 is enabled by the interval timing pulse $t_x$. Initially, the note phase adder 25 may be empty, so that during the first computation cycle the content of the adder 25 will be $qR = 1R$. At the next computing cycle, the value R will be added to the preceding content (1R), so that the adder 25 will contain 2R. In general, the note phase adder 25 will contain the value qR identifying the sample point at which the waveshape amplitude is currently being evaluated. The value qR derived from the adder 25 is supplied via a gate 27 at each occurrence of the timing pulse $t_c$ from the clock oscillator 20 to a harmonic phase adder 28 and is added to the previous content of the adder 28. The harmonic phase adder 28 is cleared by the timing pulse $t_x$ before each computation cycle of the amplitude, so that at the first timing interval $t_c$ the content of the adder 28 will be qR. For the second timing interval $t_c$, the adder 28 content will be 2qR. Thus, the harmonic phase adder 28 will contain the value nqR for the n-th harmonic component being currently evaluated. Preferably, the harmonic phase adder 28 also is of modulo N.

A sinusoid table memory 29 stores therein values of $\sin(\pi/W)\,\phi$ for $0 \leqq \phi \leqq 2W$, which may comprise a read-only memory storing the values. A memory address decoder 30 addresses the sinusoid table memory 29 in response to the value nqR in the adder 28 to thereby access from the sinusoid table memory 29 the value of $\sin(\pi/W)nqR$ corresponding to the argument nqR received from the harmonic phase adder 28.

The value of $\sin(\pi/W)nqR$ read out from the sinusoid table memory 29 is multiplied by the harmonic coefficient $C_n(t)$ for the corresponding n-th harmonic component at a harmonic amplitude multiplier 33. The multiplication product represents the amplitude $F^{(n)} = C_n(t) \cdot \sin(\pi/W)nqR$ of the n-th harmonic component and supplied to an accumulator 13 to be accumulated thereat. Thus, at the end of each interval $t_x$, the net amplitude for each sample point of the waveshape is obtained in the accumulator 13 and supplied, via a gate 14, to the digital-to-analog converter 15. The accumulator 13 is cleared by the timing pulse $t_x$ before each computation cycle, and the gate 14 is enabled by the timing pulse $t_x$ at the end of each calculation cycle.

The harmonic coefficient $C_n(t)$ for the n-th harmonic component being currently evaluated is delivered from a harmonic coefficient calculator 34 in synchronism with the timing pulse $t_c$ and is supplied to the harmonic amplitude multiplier 33 to be used in calculating the n-th harmonic component amplitude. The individual coefficients $C_n(t)$ are functions of time, which are calculated in the harmonic coefficient calculator 34 at a fairly lower time rate than the harmonic amplitude calculation timing $t_c$. This is because the sounds of a natural musical instrument will gently change in tonal quality with respect to time, as previously described, and hence it is possible to use the same set of harmonic coefficients repetitively in calculations of harmonic component amplitudes for several consecutive sample points to obtain a musical sound much simulated to that of natural musical instruments. The harmonic coefficient calculator 34 includes a buffer memory to obtain a proper matching between the high-speed harmonic amplitude multiplier 33 and the low-speed harmonic coefficient calculator 34, as described below.

Figure 3:
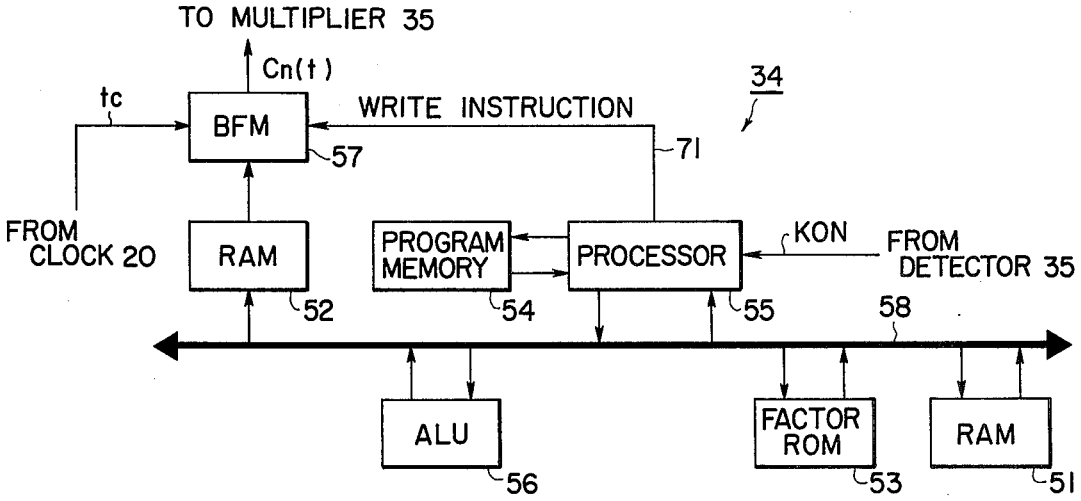
FIG. 3 is a block diagram showing an example of the harmonic coefficient calculator in the instrument of FIG. 2.

An example of the harmonic coefficient calculator 34 is illustrated in FIG. 3. This example is designed so as to calculate the individual harmonic coefficient $C_n(t)$ by implementing the following equation:

$$C_n(t) = C_n \cdot FL_n(t) \cdot CF_n(t) \qquad \text{(Eq. 2)}$$

wherein $C_n$ represents a constant for the corresponding n-th harmonic component, specifying the reference tonal quality of the regenerated musical sound, and $FL_n(t)$ is a factor for the corresponding n-th harmonic component, for attaining a certain sliding effect of the regenerated musical sound, which is calculated in accordance with the following relationship:

$$FL_n(t) = \begin{cases} 1, (\text{for } n \leqq n_c) \\ [\beta(t)\{n-\gamma(t)n_c+1\}]^{-1}, (n > n_c) \end{cases} \quad \text{(Eq. 3)}$$

Figure 5A:
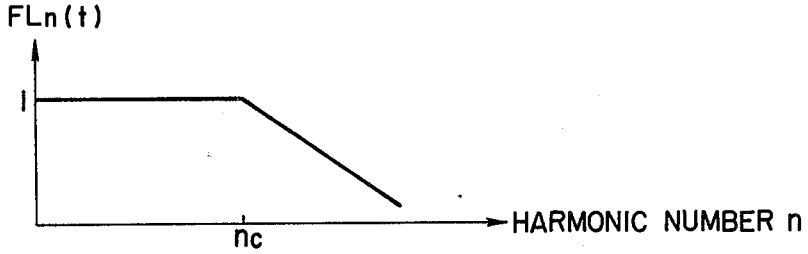
FIGS. 5A, 5B, 5C, 6A, 6B and 6C are charts illustrating the calculation formulae implemented by the harmonic coefficient calculator of FIG. 3.
Figure 5B:
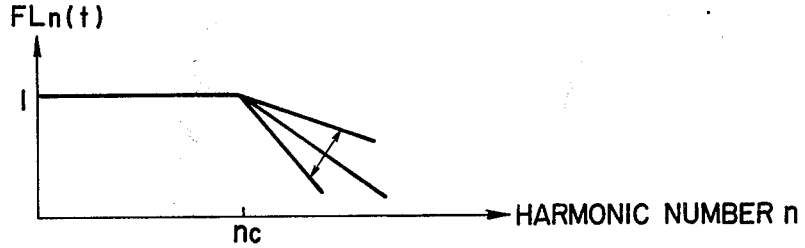
Figure 5C:
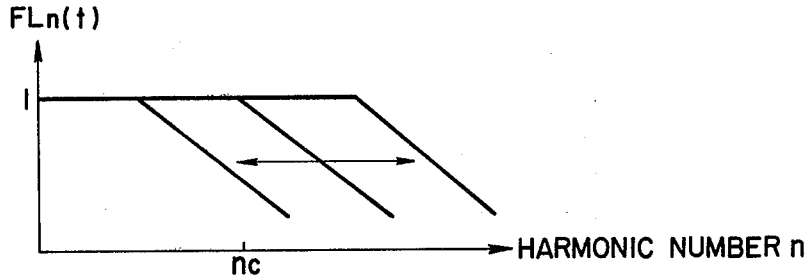

FIGS. 5A, 5B and 5C are intended for illustrating the factor $FL_n(t)$. Apparently from these figures, the factor $FL_n(t)$ has an effect on the resultant musical sound which effect is similar to that of a low-pass filter having a cut-off frequency equal to the frequency of the $n_c$-th harmonic component. As shown in FIG. 5B, the roll-off degree of the factor $FL_n(t)$ beyond $n_c$ is dependent upon the parameter $\beta(t)$, a function of time, and the harmonic number $n_c$ at which the factor $FL_n(t)$ begins to roll off is varied dependently upon the parameter $\gamma(t)$, a function of time as shown by FIG. 5C.

$CF_n(t)$ in Eq. 3 represents a factor for the corresponding n-th harmonic component, which factor being intended to attain a discrete resonance effect of the musical sound, and the effect is similar to that of the sound of a natural acoustic musical instrument. The factor $CF_n(t)$ is a function of time and is calculated in accordance with the following equation:

$$CF_n(t) = \cos^2[n \cdot \theta(t) + \alpha(t)] \quad \text{(Eq. 4)}$$

Figure 6A:
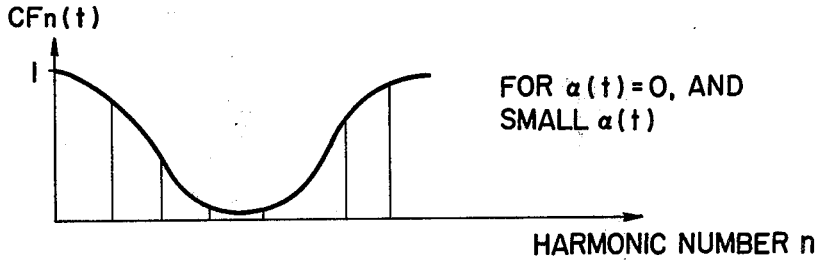
Figure 6B:
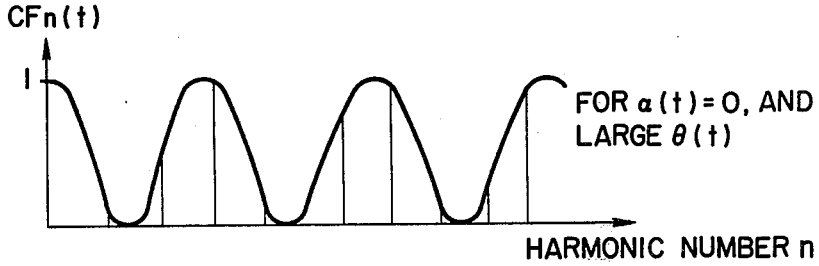
Figure 6C:
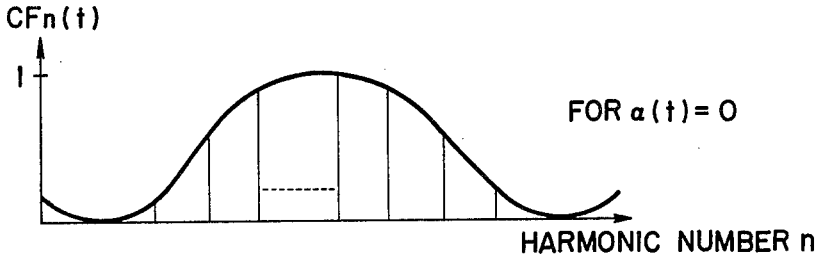

The factor $CF_n(t)$ exhibits a comb-like response as illustrated in FIGS. 6A, 6B and 6C. The pitch between the adjacent two peaks of the response of the factor $CF_n(t)$ and the harmonic numbers for which the response attains each peak or bottom level is determined by parameters $\theta(t)$ and $\alpha(t)$ which are also time functions respectively.

Referring again to FIG. 3, the harmonic coefficient calculator 34 is composed of random access memories 51 and 52, a read-only memory 53 storing those parameters $\beta(t)$, $\gamma(t)$, $n_c$, $\theta(t)$, $\alpha(t)$ and $C_n$ to be used in the calculations of the above factors $FL_n(t)$ and $CF_n(t)$, a program memory 54 storing a microprogram instructions for implementing the algorithms of Eqs. 2, 3 and 4, a processor 55, an arithmetic and logical operation circuit 56, a buffer memory 57 mentioned above which may comprise a shift register or random access memory, and a common information bus 58. The program memory 54 may comprise a read-only memory storing the micro-program instructions.

Figure 4:
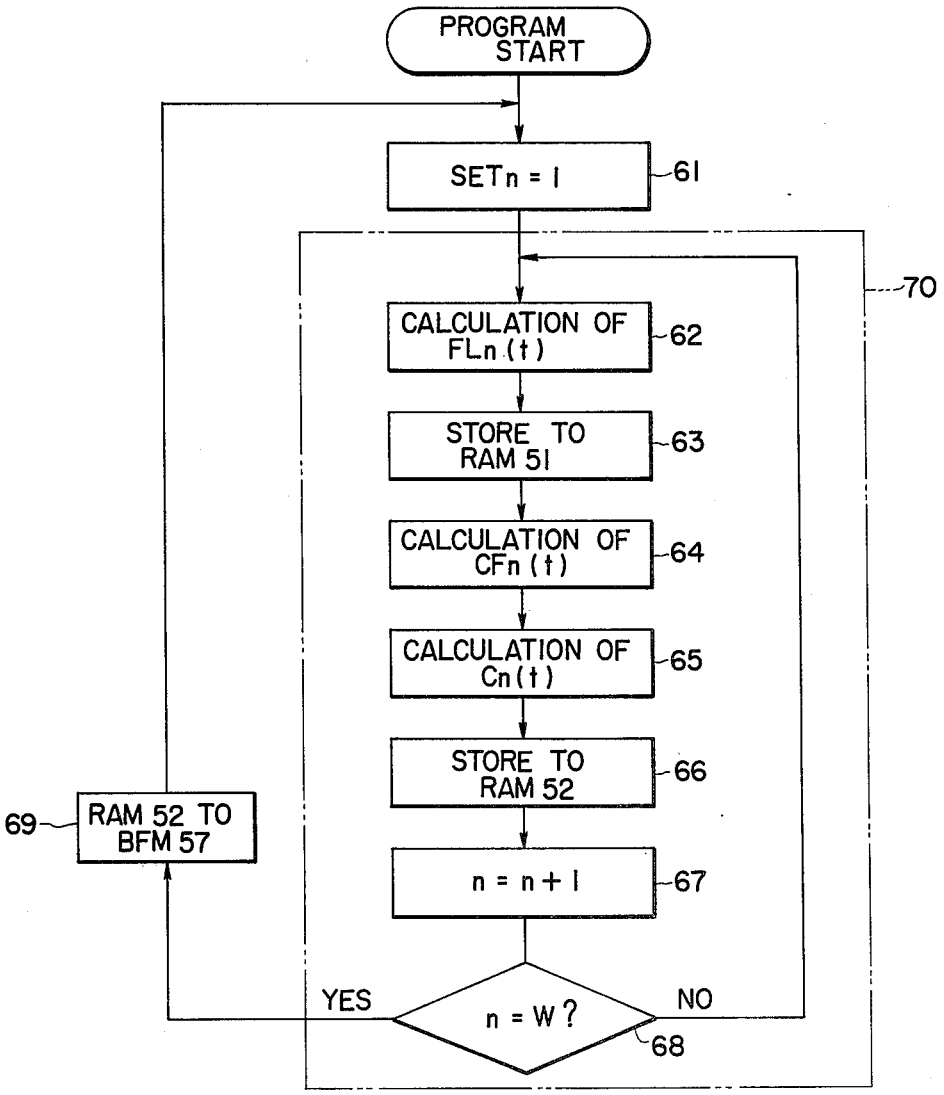
FIG. 4 is a program flow chart of the harmonic coefficient calculation algorithm performed by the harmonic coefficient calculator of FIG. 3.

Description will hereunder be made of the operation of the harmonic coefficient calculator 34, with reference to the program flow chart of FIG. 4. When one of the keyboard switches 10 is depressed, a key depression detector 35 shown in FIG. 2 generates a key-on signal KON. The key-on signal KON is kept generated as long as the selected keyboard switch 10 is depressed. Upon reception of the key-on signal KON from the keyboard depression detector 35, the processor 55 begins to operate in synchronism with an internal clock timing of the processor 55 and carries out several controlling operations for the respective portions of the harmonic coefficient calculator 34 in accordance with the program instructions retrieved from the control memory 54.

Block 61: The processor sets $n = 1$.

Block 62: The processor accesses from the parameter memory 53 the parameters $\beta(t)$, $\gamma(t)$ and $n_c$ and transfers these parameters via the common information bus 58 to the arithmetic and logical operation circuit 56. The arithmetic and logical operation circuit 56 implements the algorithm of Eq. 3 using the transferred parameters, under control of the processor 55, to obtain the factor $FL_n(t)$ for the corresponding n.

Block 63: The resultant factor $FL_n(t)$ is transferred via the common information bus 58 to the random access memory 51 to be stored at a storage location corresponding to n being currently evaluated in the memory 51.

Block 64: The parameters $\theta(t)$ and $\alpha(t)$ are retrieved from the parameter memory 53 by the processor 55 and then transferred via the common information bus 58 to the arithmetic and logical operation circuit 56. The arithmetic and logical operation circuit calculates the factor $CF_n(t)$ according to the algorithm of Eq. 4 using the transferred parameters, under the control of the processor 55.

Block 65: Multiplication of the resultant factor $CF_n(t)$ and the stored factor $FL_n(t)$ in the memory 51 is made. Then the processor 55 accesses from the parameter memory 53 the constant $C_n$ corresponding to n being currently evaluated, and transfers this parameter $C_n$ via the common information bus 58 to the arithmetic and logical operation circuit 56. The parameter, i.e., constant $C_n$, is multiplied at the operation circuit 56 by the product $FL_n(t) \cdot CF_n(t)$.

Block 66: The resultant $C_n \cdot CF_n(t) \cdot FL_n(t)$ is transferred via the common information bus 58 to the memory 52 to be stored at a storage location corresponding to n being currently evaluated in the memory 52.

Block 67: The processor 55 increments n by one.

Block 68: A determination is made as to whether the coefficients for all $W = N/2$ harmonic components have been calculated. If not, the subroutine 70 is reiterated from the step of block 62. When all coefficients have been calculated, the step of Block 69 is conducted.

Block 69: A write-instruction signal 71 is supplied from the processor 55 to the buffer memory 57, so that the stored set of coefficients $C_n(t)$ for $n = 1, 2, 3, \ldots, W$ in the memory 52 is placed into the buffer memory 57.

The above calculation cycle is repeated until the key-on signal KON ceases, i.e., until the depressed keyboard switch 10 is released. The stored coefficients $C_n(t)$ are read out individually in synchronism with the timing pulse $t_c$ from the buffer memory 57 to be supplied to the harmonic amplitude multiplier 33 in FIG. 2 for use in the harmonic amplitude calculations.

In the above embodiment, the amplitudes at successive sample points of an aimed musical sound waveshape are calculated by implementing a discrete Fourier algorithm. Therefore, the embodiment of the present invention can produce only a musical sound consisting of components at frequencies which are harmonically related to the fundamental frequency of the musical sound. However, it will be understood by those skilled in the art that the present invention can also provide an electronic musical instrument which is capable of producing a musical sound including the components at frequencies in harmonically related to the fundamental frequency of the musical sound in addition to the components at frequencies harmonically related to the fundamental frequency by, for instance, changing the calculation method of respective constituent components of the aimed composite musical sound waveshape. In effect, the present invention is applicable to any electronic musical instrument wherein for each sample point of the aimed musical sound waveshape, the individual amplitudes of constituent components of the musical sound waveshape are calculated using a set of weighting coefficients for the corresponding constituent components which coefficients are intended to specify the relative amplitudes of the components.

What is claimed is:

1. An electronic musical instrument comprising:

a first means for producing the amplitudes of respective partial components constituting a composite waveshape at successive sample points of said composite waveshape;

a second means for implementing, at first regular time intervals, multiplications of said amplitudes and coefficients associated with said respective partial components to obtain said amplitudes weighted by said coefficients;

a third means for repetitively calculating, at second regular time intervals which are respectively longer than said first regular time intervals, a set of said coefficients associated with all of said partial components, as said multiplications are carried out;

a fourth means for receiving said set of coefficients from said third means to temporarily store this set of coefficients until a new set of said coefficients is received from said third means, and for supplying said stored set of coefficients to said second means in synchronism with said multiplications to be used in implementing said multiplications by said second means; and a fifth means for converting said set of amplitudes weighted for each said sample point of said composite waveshape to a musical sound.

2. An electronic musical instrument according to claim 1, wherein: said set of amplitudes weighted for each sample point is a digital representation, and said fifth means includes a digital-to-analog converter for converting said set of amplitudes weighted in digital representation to a corresponding analog voltage, and a sound system for receiving said analog voltage to thereby reproduce said musical sound.

3. An electronic musical instrument according to claim 2, wherein: said fifth means further includes an accumulator for accumulating said amplitudes weighted to obtain said set of amplitudes weighted for each said sample point.

4. An electronic musical instrument according to claim 1, wherein: said coefficients are calculated by said third means by implementing the algorithm of a certain function of time, using several parameters.

5. An electronic musical instrument according to claim 4, wherein: said third means includes: a first memory storing said parameters; a second memory storing program instructions for implementing said algorithm; a program execution means operative repetitively at said second regular time intervals while said first means is producing said amplitudes, for executing said program instructions retrieved from said second memory and thereby calculating said coefficients individually using said parameters retrieved from said first memory; and a third memory; each coefficient associated with said respective partial components which is calculated by said program execution means being stored successively at a corresponding storage location in said third memory, upon completion of storing a set of said coefficients associated with every said partial component into said third memory, this stored set of coefficients being placed to said fourth means.

6. An electronic musical instrument according to claim 4, wherein: said certain function of time is expressed by $$C_n(t) = C_n \cdot FL_n(t) \cdot CF_n(t)$$

wherein: $C_n$ represents constants associated with said respective n-th partial components, and $FL_n(t)$ represents a function of time expressed by $$FL_n(t) = \begin{cases} 1 \text{ for } n \leqq n_c \\ [\beta(t)\{n-\gamma(t)n_c+1\}]^{-1} \text{ for } n > n_c \end{cases}$$

wherein: $\beta(t)$, $\gamma(t)$, $C_n$ and $n_c$ are contained in said parameters, and $CF_n(t)$ represents a function of time expressed by $$CF_n(t) = \cos^2[N \cdot \theta(t) + \alpha(t)]$$

wherein: $\theta(t)$ and $\alpha(t)$ are contained in said parameters.

7. An electronic musical instrument according to claim 1, wherein: said respective partial components are components at frequencies generally harmonically related to the fundamental frequency of said composite waveshape, and said first means is arranged so as to produce values of $\sin(\pi/W)nqR$ as said amplitudes, wherein $n = 1, 2, 3, \ldots, w$ designates particular one of said partial components, W represents the number of said partial components, qR designates said sample point being evaluated, R represents a number specifying said fundamental frequency, and q is an integer incremented each third regular time interval which interval is W times said first regular time interval, said first means comprising: a sinusoid table comprising a memory storing values of $\sin(\pi/W)\phi$ for $0 \leqq \phi < 2W$; and a circuitry for accessing from said sinusoid table the values of $\sin(\pi/W)nqR$ for each of said W partial components in accordance with a selected value R.

8. An electronic musical instrument according to claim 7, wherein: said circuitry comprises: a note interval adder for adding said selected value R to preceding contents of said note interval adder at the beginning of each said third regular time interval, the contents of said note interval adder thereby representing qR; a partial interval adder, cleared at the beginning of each said third regular time interval, for repetitively adding the value qR obtained from said note interval adder to the preceding contents of said partial interval adder, the contents of said partial interval adder thereby representing the value nqR where n is equal to the number of such repetitive additions since the beginning of each said third regular time interval; and a memory address decoder for addressing said sinusoid table in response to the value nqR contained in said partial interval adder, to thereby access from said sinusoid table the corresponding stored value of $\sin(\pi/W)nqR$.

9. An electronic musical instrument according to claim 7, further comprising: a frequency number memory storing a plurality of said different values R; and instrument keyboard switches comprising plural switches, from said frequency number memory is accessed particular one of said stored values qR corresponding to the closed one of said plural switches to be supplied to said note interval adder.

10. An electronic musical instrument according to claim 1, further comprising: a means for selecting a fundamental frequency of said composite waveshape.

* * * * *